US005999761A

United States Patent [19]

Binder et al.

[11] Patent Number: 5,999,761

[45] Date of Patent: Dec. 7, 1999

[54] DYNAMIC ADJUSTMENT OF CHARACTERISTICS OF AN IMAGE FORMING APPARATUS

[75] Inventors: Andrew J. Binder, Lake Zurich, Ill.; Quintin T. Phillips; K. Trent Christensen, both of Boise, Id.

[73] Assignee: Hewlett-Packard Company, Palo Alto, Calif.

[21] Appl. No.: 09/115,578

[22] Filed: Jul. 14, 1998

[51] Int. Cl.[6] ..... G03G 15/00

[52] U.S. Cl. ..... 399/49; 399/60; 399/72

[58] Field of Search ..... 399/45, 46, 49, 399/50, 51, 52, 55; 355/53, 67, 71; 359/558, 559, 560

[56] References Cited

U.S. PATENT DOCUMENTS

| | | | |
|---|---|---|---|
| 4,026,643 | 5/1977 | Bergman | 399/60 |
| 5,250,988 | 10/1993 | Matsuura et al. | 399/42 |
| 5,272,503 | 12/1993 | LeSueur et al. | 399/25 |
| 5,621,497 | 4/1997 | Terasawa et al. | 355/53 |

*Primary Examiner*—Arthur T. Grimley
*Assistant Examiner*—Hoang Ngo

[57] ABSTRACT

An image forming apparatus in accordance with the invention includes a print engine with a photoreceptor, a laser exposure device for creating an image on the photoreceptor and one or more toning stations for toning the photoreceptor, after imaging. A system for enabling adjustment of the apparatus performance characteristics further includes a sensor for detecting characteristics of a toned image on the photoreceptor. A memory is provided for storing control parameters used to adjust operations of the printer; desired image characteristic parameters and previously measured image parameters. A processor is responsive to a performance assessment procedure for causing the print engine to create a toned test image on the photoreceptor. The processor then compares signals that are indicative of characteristic parameters of the toned test image with desired image characteristic parameters from the memory. Thereafter, in accordance with the comparison, the processor adjusts printer control parameters to bring the characteristics of the printed image closer to those which are dictated by the desired image characteristic parameters.

8 Claims, 2 Drawing Sheets

DYNAMIC ADJUSTMENT OF CHARACTERISTICS OF AN IMAGE FORMING APPARATUS

FIELD OF THE INVENTION

This invention relates to adjustment of parameters that control operation of an image forming apparatus to assure a high quality image output and, more particularly, to a method and apparatus for dynamically adjusting printer control parameters in accordance with characteristics of a test pattern and comparison of measurements thereof with predetermined parameters.

BACKGROUND OF THE INVENTION

Many image forming devices, e.g., copiers, printers, plotters, etc., include a controlling microprocessor which stores calibration data that enable adjustment of internal components in such a manner as to assure high quality document production. The calibration data is generally configured in the form of control parameters which are stored in either a random access memory or read-only memory, as the case may be. The prior art teaches that such parameters can be stored directly on memory chips that are resident on replaceable consumable devices utilized with such devices.

In laser based printers, the electrophotographic process relies on control of toner particles and charge states. These fundamental materials and forces are influenced by a variety of external and internal conditions experienced in the printing process. Humidity, temperature, contaminants found on the surface of the photoreceptor, conditioning of the photoreceptor by previously printed patterns, manufacturing variations, etc. all affect the quality of printed image. Most electrophotographic processes incorporated into laser printers select specific operating conditions which are then held constant. At times, such operating conditions may be adjusted in accordance with temperature and/or humidity conditions. Nevertheless, the conditions are set so as to try to achieve acceptable printed images under most of the potential conditions which may be experienced by the printer.

U.S. Pat. No. 4,961,088 to Gilliland et al. describes a toner cartridge which includes a programmable read-only memory that is programmed with a cartridge identification number. That cartridge identification number, when matched with a cartridge identification number stored in a printer that receives the cartridge, enables further printer operations. The read-only memory on the cartridge also includes a cartridge replacement warning count and a termination count at which the cartridge is disabled from further use. The read-only memory on the cartridge further stores updated counts of the remaining number of images left on the cartridge, after each print run.

U.S. Pat. No. 5,049,898 to Arthur et al., assigned to the same Assignee as this Application, discloses a disposable printing assembly wherein an integral memory element stores data that characterizes the assembly. Arthur et al. provide an inkjet printhead assembly with a memory which designates the color of the ink in the printhead, its amount and the position of the inkjet orifice plate on the printhead body. This data is read from the printhead by a read/write element in the printer and is then used or displayed, as desired.

U.S. Pat. No. 5,491,540 to Hirst, assigned to the same Assignee as this application, describes a printer/copier apparatus wherein a disposable part of the apparatus includes a memory chip with control parameters relating to the consumable. Data transfers are enabled both to and from the memory chip via a serial access line (which replaces a previously used fuse connection).

U.S. Pat. Nos. 5,138,344 to Ujita; 5,365,312 to Hillmann et al.; and 5,610,635 to Murray et al. all relate to and describe various aspects of memory storage elements that are incorporated on ink cartridges used with inkjet printers. In each case, the memory storage element includes data related to the consumption of ink from the ink cartridge; the ink color and other data relating to the consumable.

U.S. Pat. No. 5,235,384 to Oka et al. describes a print apparatus wherein a user's selection of a print mode enables control conditions to be read from a memory included on a consumable item that is incorporated into the printer. Those parameters are then used to set up the printer in accordance with the desired mode.

Notwithstanding that various control parameters are taught as being stored on memory chips resident on consumable items, use of such parameters (and their updates) is generally based upon projected changes in print image characteristics which result from alterations of the state of the consumable items. Such alterations are those which are predicted by the manufacturer, but which may not be entirely accurate due to the wide variety of changes which can occur in the print mechanism and consumable items.

Accordingly, it is an object of this invention to provide a method and apparatus for adaptively controlling a printer which is subject to changed print conditions.

It is another object of this invention to provide an improved adaptive printer control method and apparatus wherein altered control conditions are achieved through examination of actually produced images.

SUMMARY OF THE INVENTION

An image forming apparatus in accordance with the invention includes a print engine with a photoreceptor, a laser exposure device for creating an image on the photoreceptor and one or more toning stations for toning the photoreceptor, after imaging. A system for enabling adjustment of the apparatus' performance characteristics further includes a sensor for detecting characteristics of a toned image on the photoreceptor. A memory is provided for storing control parameters used to adjust operations of the printer; desired image characteristic parameters and previously measured image parameters. A processor is responsive to a performance assessment procedure for causing the print engine to create a toned test image on the photoreceptor. The processor then compares signals that are indicative of characteristic parameters of the toned test image with desired image characteristic parameters from the memory. Thereafter, in accordance with the comparison, the processor adjusts printer control parameters to bring the characteristics of the printed image closer to those which are dictated by the desired image characteristic parameters. Once the parameter adjustment is achieved, the revised control parameters may be stored on a memory that is integral with a consumable in the printer.

DETAILED DESCRIPTION OF THE INVENTION

While the invention will hereafter be described in the context of a laser printer, it is to be understood that the invention is equally applicable to other image forming devices such as inkjet printers, plotters, copying mechanisms, etc. Accordingly, the invention is to e considered in the broad context of image forming devices.

Figure 1:
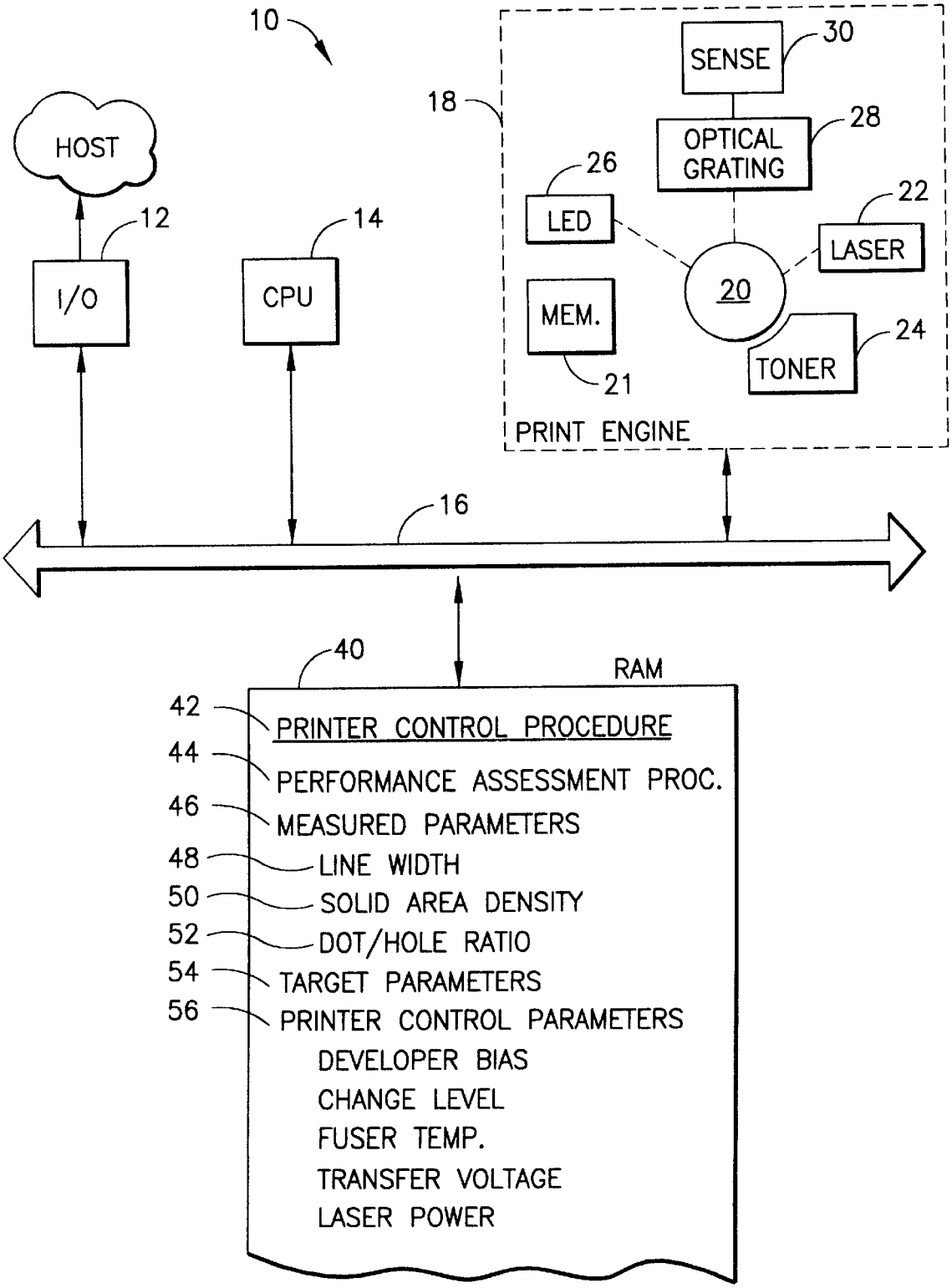
FIG. 1 is a high level block diagram of an image forming apparatus in accordance with the invention.

Referring to FIG. 1, a laser printer 10 includes an input/output module 12 for receiving image data from a host processor. A central processing unit (CPU) 14 is coupled to a bus system 16 (along with I/O module 12) to enable communications with other elements of printer 10. A print engine 18 includes a removable photoreceptor 20 that includes an integral memory chip 21 mounted therewith. Print engine 18 further includes a laser 22 whose output is scanned across the surface of photoreceptor 20 in the known manner to create an image thereon. One or more toner modules 24 are utilized to apply toner particles to the charged image on photoreceptor 20. Thereafter, the toned image is transferred to a media sheet which, in turn, is carried out of printer 10 by a media transport mechanism (not shown).

Prior to the toned image being transferred to the media sheet, the toned image passes beneath a set of light emitting diodes 26 which illuminate the surface of the toned image as it passes beneath an optical grating 28 and an optical sensor 30.

As will be hereafter understood, a test pattern is periodically caused to be generated on photoreceptor 20 and the pattern is viewed by sensor 30 through optical grating 28 to achieve control signals in accordance with the sensed pattern on photoreceptor 20. The generation of interference patterns, resulting from the presence of grating 28, allows the electrophotographic process to be adjusted for optimum performance, through analysis of the interference patterns.

Interference patterns are useful for analyzing anomalies or small changes in generally uniform patterns. The interference pattern is generated by viewing the test pattern through a known uniform grid. By constructing optical grating 28 with sufficient resolution, it is possible to detect changes in the test pattern on photoreceptor 20 that are much smaller than the spacing of the test pattern lines. Thus, for instance, when a test pattern of lines is written by laser 22 on photoreceptor 20 and is then developed by application of toner particles, the test pattern is subsequently viewed by sensor 30 through optical grating 28. The rotation of photoreceptor 20 causes a pulsing of the optical signal generated by sensor 30 to occur at a uniform rate. Thus, changes in frequency and/or intensity of the pulsed optical signals can be precisely detected and related to changes in the system's ability to uniformly construct lines.

Accordingly, using the output from sensor 30, CPU 14 can calculate adjustments to control parameters to enable the creation of more precise linewidths. Such parameter adjustments may control laser power, dot position, developer bias, charge levels, etc., etc.

To enable operation of such an adaptive procedure, laser printer 10 includes a random access memory (RAM) 40 which includes a printer control procedure 42 which, in conjunction with CPU 14, controls the operation of laser printer 10. Printer control procedure 42 includes a performance assessment procedure 44 which periodically causes a test pattern to be produced on photoreceptor 20. That test pattern is later analyzed by comparison of the parameter values derived from outputs from sensor 30 to stored parameter values that would be expected to be produced by a test pattern of a quality which matches desired print characteristics.

Briefly stated, performance assessment procedure 44 receives input signals from sensor 30 that are indicative of interference patterns produced by optical grating 28. Those input signals enable generation of a set of measured parameters 46 which are indicative of image characteristics of the test pattern, e.g., linewidth 48, solid area density 50, dot/white ratio 52, etc. Those measured parameters are then compared to a stored set of target parameters 54 and difference values are derived therebetween. Depending upon the difference values, performance assessment procedure 44 produces parameter adjustment signals for various control parameters 56 that are stored in RAM 40 (or elsewhere). Depending upon the determined parameter adjustment signals, one or more of the following may be adjusted: developer bias, photoreceptor charge level, fuser temperature, transfer voltage, laser power, etc., etc.

Figure 2:
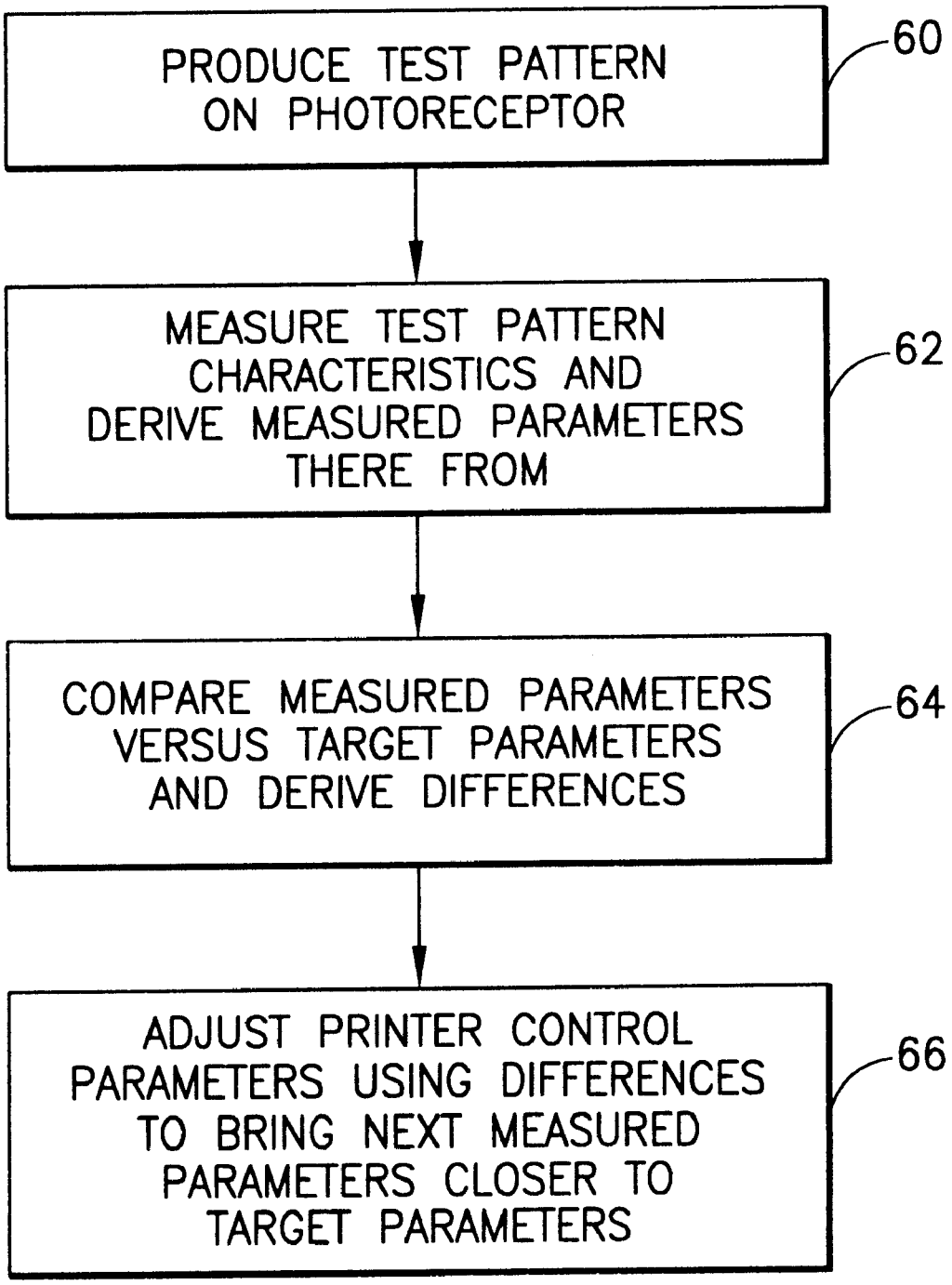
FIG. 2 is a high level flow diagram illustrating the method of the invention.

Turning now to FIG. 2, the method performed by performance assessment procedure 44 will be further described. Periodically, performance assessment procedure 44 is operated by printer control procedure 42 to print a test pattern on photoreceptor 20 (step 60). Thereafter, the toned test pattern on photoreceptor 20 is sensed by sensor 30, through optical grating 28, and the outputs from sensor 30 are measured to determine certain parameters 46 of the test pattern (step 62). Thereafter, the measured test pattern parameters 46 are compared against target parameters 54 to determine differences therebetween (step 64).

Once the differences between measured test pattern parameters 46 and target parameters 54 have been determined, performance assessment procedure 44 controls CPU 14 to adjust one or more control parameters 56 so as to alter the print conditions in a manner to bring subsequently measured test pattern parameters towards target parameters 54 (step 66).

If desired, the measured test pattern parameters may be stored in either RAM 40 or on memory chip 21, for comparison with later measured values. Thus, during a next operation of performance assessment procedure 44, both the previously measured test pattern parameters and newly measured test pattern parameters may be utilized to enable further analysis of changes in the imaging procedure performed by print engine 18.

It should be understood that the foregoing description is only illustrative of the invention. Various alternatives and modifications can be devised by those skilled in the art without departing from the invention. For instance, while the invention has been described assuming that the test pattern is sensed directly from the photoreceptor, the test pattern can also be sensed after transfer to a transfer system or a media sheet. Clearly, this would require a reorientation of the optical illumination/sensing apparatus within the printer. Accordingly, the present invention is intended to embrace all such alternatives, modifications and variances which fall within the scope of the appended claims.

We claim:

1. A method for adjusting performance of an image forming device, comprising the steps of:

producing a test pattern image;

detecting image characteristics indicative of said test pattern image and producing measured signal data in accordance therewith;

comparing said measured signal data with stored target signal data indicative of desired image characteristics;

adjusting control parameters used to operate said image forming device in a manner to bring said image characteristics that are detected closer to said desired image characteristics; and wherein said detected image characteristics, indicative of said test pattern image, are configured in a form of an interference pattern that is created by illuminating said test pattern and viewing said illuminated test pattern through an optical grating.

2. The method as recited in claim 1 wherein said image forming device is a laser printer and said test pattern image is produced on a photoreceptor included in said printer, and wherein said detecting step detects image characteristics of a toned image on said photoreceptor.

3. The method as recited in claim 1 wherein said image characteristics that are detected include linewidth, solid area ink density and dot/hole ratio.

4. The method as recited in claim 2 wherein said photoreceptor is included as part of a removable replaceable item and includes a resident memory thereon, said method further comprising the step of:

recording on said resident memory of said replaceable item, measured parameters from said test pattern image for later use by said printer during a subsequent test procedure.

5. A system for enabling adjustment of performance of an image forming apparatus, said image forming apparatus comprising a print engine with a photoreceptor, exposure means for creating an image on said photoreceptor, and means for toning said image on said photoreceptor, said system further comprising:

sensor means for detecting characteristics of a toned image on said photoreceptor;

memory means for storing control parameters used to control operations of said image forming apparatus and target signal data indicative of desired image characteristic; and processor means (i) for causing said print engine to create a toned test pattern on said photoreceptor, (ii) for detecting image characteristics indicative of said test pattern image and producing measured signal data in accordance therewith, (iii) for comparing said measured signal data with stored target signal data indicative of said desired image characteristics, and (iv) for adjusting control parameters used to operate said image forming apparatus in a manner to bring said image characteristics that are detected closer to said desired image characteristics; and wherein said detected image characteristics, indicative of said test pattern image, are configured in a form of an interference pattern that is created by illuminating said test pattern and viewing said illuminated test pattern through an optical grating.

6. The system as recited in claim 5 wherein said image forming apparatus is a laser printer and said test pattern image is produced on said photoreceptor, and wherein said image characteristics are detected by said sensor means.

7. The system as recited in claim 5 wherein said image characteristics that are detected include linewidth, solid area ink density and dot/hole ratio.

8. The system as recited in claim 6 wherein said photoreceptor is included as part of a removable replaceable item and includes a resident memory thereon, said processor means further (v) recording on said resident memory of said replaceable item, measured parameters from said test pattern image for later use by said printer during a subsequent test procedure.

* * * * *